US011971180B2

(12) United States Patent
Zhang et al.

(10) Patent No.: US 11,971,180 B2
(45) Date of Patent: Apr. 30, 2024

(54) OUTDOOR UNIT OF AIR CONDITIONER, AND AIR CONDITIONER

(71) Applicant: Hisense (Guangdong) Air Conditioning Co., Ltd., Guangdong (CN)

(72) Inventors: Jianneng Zhang, Guangdong (CN); Yongping Cao, Guangdong (CN); Xidong Li, Guangdong (CN); Minan Wu, Guangdong (CN); Xiaoqin Wei, Guangdong (CN); Jihua Chen, Guangdong (CN)

(73) Assignee: HISENSE (GUANGDONG) AIR CONDITIONER CO., LTD., Guangdong (CN)

( * ) Notice: Subject to any disclaimer, the term of this patent is extended or adjusted under 35 U.S.C. 154(b) by 388 days.

(21) Appl. No.: 17/364,309

(22) Filed: Jun. 30, 2021

(65) Prior Publication Data

US 2021/0325055 A1 Oct. 21, 2021

Related U.S. Application Data

(63) Continuation of application No. PCT/CN2020/072309, filed on Jan. 15, 2020.

(30) Foreign Application Priority Data

Jan. 15, 2019 (CN) ..... 201910036332.8

(51) Int. Cl.

| | |
|---|---|
| ***F24F 1/20*** | (2011.01) |
| ***F24F 11/46*** | (2018.01) |
| ***F24F 11/88*** | (2018.01) |

(52) U.S. Cl.
CPC ..... *F24F 1/20* (2013.01); *F24F 11/46* (2018.01); *F24F 11/88* (2018.01)

(58) Field of Classification Search
CPC ..... F24F 11/46; F24F 1/20; F24F 11/88
See application file for complete search history.

(56) References Cited

U.S. PATENT DOCUMENTS

| | | | |
|---|---|---|---|
| 2016/0273792 | A1 | 9/2016 | Xi et al. |
| 2017/0063249 | A1 | 3/2017 | Seo et al. |

FOREIGN PATENT DOCUMENTS

| | | | |
|---|---|---|---|
| CN | 1292077 | A | 4/2001 |
| CN | 103163452 | A | 6/2013 |

(Continued)

OTHER PUBLICATIONS

Office Action issued in corresponding Australian Application No. 2020209621 dated Mar. 29, 2022.

(Continued)

*Primary Examiner* — Ana M Vazquez
(74) *Attorney, Agent, or Firm* — Morgan, Lewis & Bockius LLP

(57) ABSTRACT

An outdoor unit of an air conditioner includes an outdoor-unit main control circuit, a power supply, a power supply control circuit, and an outdoor-unit communication circuit. The power supply control circuit is disposed in a loop of a power supply line for supplying power to the power supply, and is configured to control the power supply line to supply power to the power supply by controlling on/off of the loop; and the power supply is configured to supply power to the outdoor-unit main control circuit and the outdoor-unit communication circuit after receiving the power supplied from the power supply line.

17 Claims, 7 Drawing Sheets

(56) References Cited

FOREIGN PATENT DOCUMENTS

| | | | | |
|---|---|---|---|---|
| CN | 202993474 | U | | 6/2013 |
| CN | 105066385 | A | | 11/2015 |
| CN | 204787051 | U | | 11/2015 |
| CN | 205299834 | U | | 6/2016 |
| CN | 103163452 | B | | 8/2016 |
| CN | 106482215 | A | | 3/2017 |
| CN | 107906697 | A | | 4/2018 |
| CN | 207281508 | U | | 4/2018 |
| CN | 108488948 | A | | 9/2018 |
| CN | 109764503 | A | | 5/2019 |
| EP | 1 036 995 | A1 | | 9/2000 |
| JP | 2010-54065 | A | | 3/2010 |
| JP | 2010054065 | A | * | 3/2010 |
| JP | 2011-144951 | A | | 7/2011 |
| JP | 2016-205687 | A | | 12/2016 |
| KR | 10-2015-0122477 | A | | 11/2015 |
| KR | 10-1919800 | B1 | | 11/2018 |
| WO | 2017/199276 | A1 | | 11/2017 |

OTHER PUBLICATIONS

International Search Report and Written Opinion issued in corresponding International Application No. PCT/CN2020/072309 dated Apr. 9, 2020, with English translation.

First Office Action issued in corresponding Chinese Patent Application No. 201910036332.8 dated May 6, 2020, with English translation.

Second Office Action issued in corresponding Chinese Patent Application No. 201910036332.8 dated Nov. 13, 2020, with English translation.

First Office Action issued in corresponding Chinese Patent Application No. 202080000202.X dated Mar. 25, 2021, with English translation.

* cited by examiner

OUTDOOR UNIT OF AIR CONDITIONER, AND AIR CONDITIONER

CROSS-REFERENCE TO RELATED APPLICATION

This application is a Bypass Continuation Application of International Patent Application No. PCT/CN2020/072309 filed on Jan. 15, 2020, which claims priority to Chinese Patent Application No. 201910036332.8, filed with the Chinese Patent Office on Jan. 15, 2019, which are incorporated herein by reference in their entireties.

TECHNICAL FIELD

The present disclosure relates to the field of control technology, and in particular, to an outdoor unit of an air conditioner, and an air conditioner.

BACKGROUND

With a progress of society and a development of science and technology, air conditioners have entered thousands of households. With increasing popularity of air conditioners, users have begun to pay more and more attention to an energy efficiency ratio of the air conditioners. The energy efficiency ratio refers to energy conversion efficiency, and is a ratio of heat output by an air conditioner to electrical energy input to the air conditioner. The greater the energy efficiency ratio is, the more electrical energy the air conditioner saves. At present, environmental protection and energy saving are increasingly pursued, and the energy efficiency ratio of the air conditioner is more and more concerned besides refrigeration and noise reduction. In particular, power consumption of the air conditioner in a standby state is increasingly becoming a focus of attention for users and technicians.

SUMMARY

In an aspect, an outdoor unit of an air conditioner is provided. The outdoor unit of an air conditioner includes an outdoor-unit main control circuit, a power supply, a power supply control circuit, and an outdoor-unit communication circuit. The outdoor-unit main control circuit is configured to control operations of the power supply, the power supply control circuit and the outdoor-unit communication circuit, and control a communication between the outdoor unit of the air conditioner and an indoor unit of the air conditioner. The outdoor-unit communication circuit is configured to communicate with the indoor unit of the air conditioner through a signal line connecting an indoor-unit communication circuit of the indoor unit of the air conditioner and the outdoor-unit communication circuit. The power supply control circuit is disposed in a loop of a power supply line for supplying power to the power supply, and is configured to control the power supply line to supply power to the power supply by controlling on/off of the loop. The power supply is configured to supply power to the outdoor-unit main control circuit and the outdoor-unit communication circuit after receiving the power supplied from the power supply line.

In another aspect, an air conditioner is provided. The air conditioner includes an indoor unit of the air conditioner, the outdoor unit of the air conditioner and a power supply line for providing the air conditioner with commercial power. The indoor unit of the air conditioner includes an indoor-unit communication circuit and an indoor-unit main control circuit. The indoor-unit communication circuit is connected to the outdoor-unit communication circuit of the outdoor unit of the air conditioner through a signal line, and is connected to the power supply control circuit of the outdoor unit of the air conditioner through the signal line. A live wire terminal of the outdoor unit of the air conditioner is connected to a live wire terminal of the indoor unit of the air conditioner, and both of live wire terminals are jointly connected to a live wire of the power supply line. A neutral wire terminal of the outdoor unit of the air conditioner is connected to a neutral wire terminal of the indoor unit of the air conditioner, and both of neutral wire terminals are jointly connected to a neutral wire of the power supply line.

DETAILED DESCRIPTION

Figure 1:
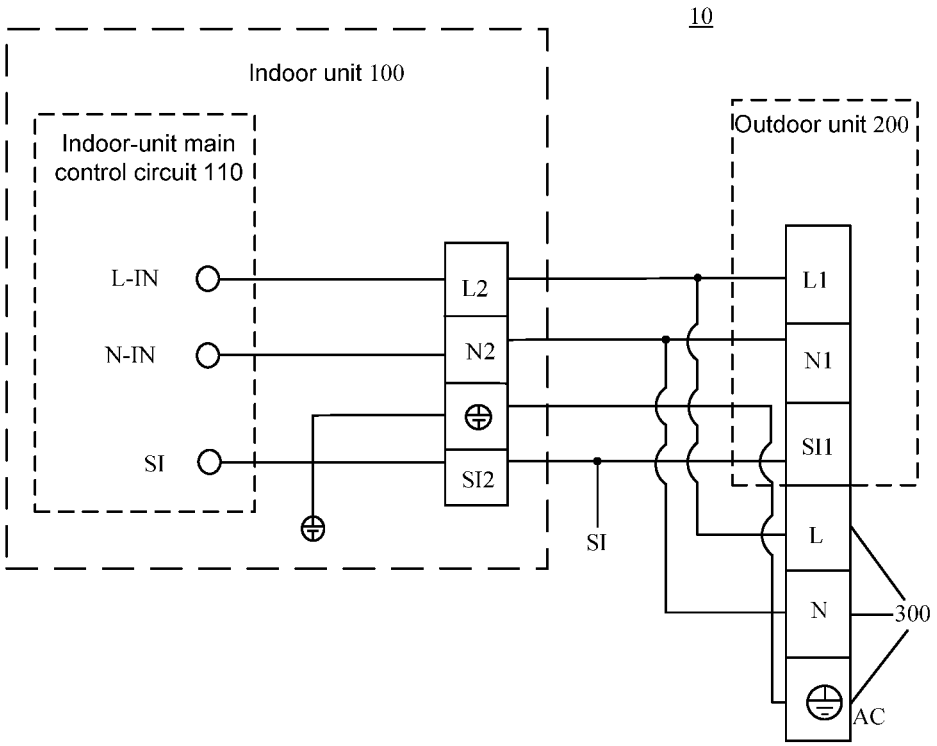
FIG. 1 is a circuit diagram showing connection between an indoor unit and an outdoor unit in an air conditioner in accordance with some embodiments.

Technical solutions in some embodiments of the present disclosure will be described below clearly and completely with reference to the accompanying drawings below. Obviously, the described embodiments are merely some but not all embodiments of the present disclosure. All other embodiments obtained based on the embodiments of the present disclosure by a person of ordinary skill in the art shall be included in the protection scope of the present disclosure.

Unless the context requires otherwise, throughout the description and the claims, the term "comprise" and other forms thereof such as the third-person singular form "comprises" and the present participle form "comprising" are construed as open and inclusive, that is, "including, but not limited to." In the description, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, features defined as "first" and "second" may explicitly or implicitly include one or more of the features. In the description of the embodiments of the present disclosure, the term "a plurality of" means two or more unless otherwise specified.

In the description of some embodiments, the terms "coupled" and "connected" and their extensions may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The phrase "at least one of A, B and C" has a same meaning as the phrase "at least one of A, B or C", and they both include the following combinations of A, B and C: only A, only B, only C, a combination of A and B, a combination of A and C, a combination of B and C, and a combination of A, B and C. The phrase "A and/or B" includes the following three combinations: only A, only B, and a combination of A and B.

As used herein, the term "if" is optionally construed as "when" or "in a case where" or "in response to determining" or "in response to detecting", depending on the context. Similarly, the phrase "if it is determined" or "if [the stated condition or event] is detected" is optionally construed as "in a case where it is determined" or "in response to determining" or "in a case where [the stated condition or event] is detected" or "in response to detecting [stated condition or event]", depending on the context.

The use of the phrase "applicable to" or "configured to" herein means an open and inclusive language, which does not exclude devices that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or values exceeding those stated.

The term "about", "substantially" or "approximately" as used herein includes a stated value and an average value within an acceptable range of deviation of a particular value determined by a person of ordinary skill in the art, considering measurement in question and errors associated with measurement of a particular quantity (i.e., limitations of a measurement system).

Some embodiments of the present disclosure provide an air conditioner 10. As shown in FIG. 1, the air conditioner 10 includes an indoor unit 100 (also referred to as an air conditioner indoor unit) and an outdoor unit 200 (also referred to as an air conditioner outdoor unit). The indoor unit 100 is disposed indoors, and the outdoor unit 200 may be disposed outdoors. The air conditioner 10 further includes a power supply line 300 for providing the air conditioner 10 with commercial power. The power supply line 300 includes a live wire L, a neutral wire N and a ground wire shown in FIG. 1.

As shown in FIG. 1, the outdoor unit 200 includes a wiring terminal SI1 of an outdoor-unit communication circuit (to be described later), a live wire terminal L1, and a neutral wire terminal N1. The indoor unit 100 includes a wiring terminal SI2 of an indoor-unit communication circuit (to be described later), a live wire terminal L2, and a neutral wire terminal N2. The wiring terminal SI1 of the outdoor-unit communication circuit is connected to the wiring terminal SI2 of the indoor-unit communication circuit through a signal line (SI). The live wire terminal L1 of the outdoor unit 200 is connected to the live wire terminal L2 of the indoor unit 100, and they are jointly connected to the live wire L of the power supply line 300. The neutral wire terminal N1 of the outdoor unit 200 is connected to the neutral wire terminal N2 of the indoor unit 100, and they are jointly connected to the neutral wire N of the power supply line 300. That is, the outdoor unit 200 and the indoor unit 100 may be powered by the same power supply line 300.

Figure 2:
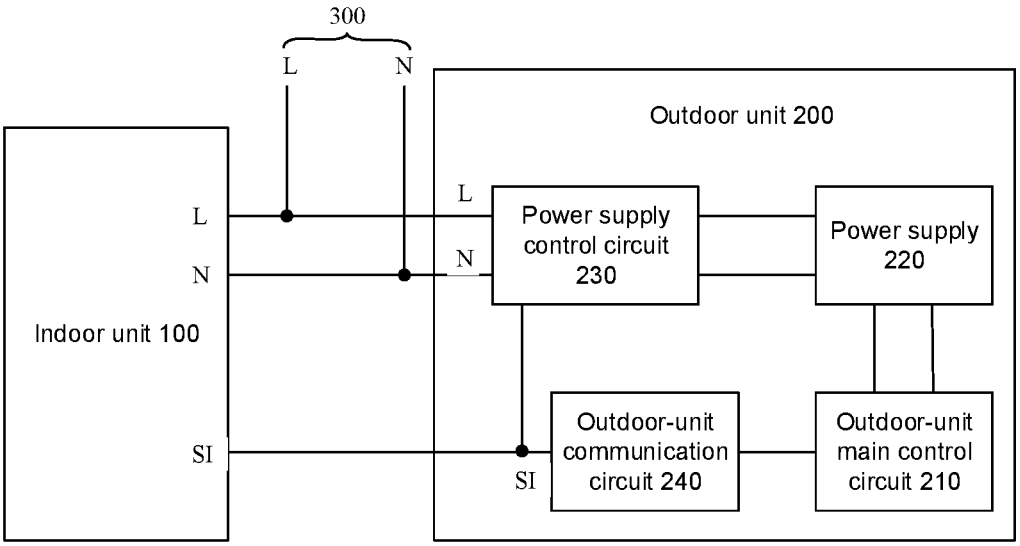
FIG. 2 is a block diagram showing a structure of an outdoor unit in an air conditioner in accordance with some embodiments.

As shown in FIG. 2, the outdoor unit 200 further includes an outdoor-unit main control circuit 210 (also referred to as an outdoor-unit main control board), a power supply 220, a power supply control circuit 230 and an outdoor-unit communication circuit 240.

The outdoor-unit main control circuit 210 is configured to control operation of other modules (e.g., the power supply control circuit 230) of the outdoor unit 200, and to control a communication between the outdoor unit 200 and the indoor unit 100. The outdoor-unit main control circuit 210 may be a control chip or a circuit including a control chip. In some embodiments of the present disclosure, the outdoor-unit main control circuit 210 is further configured to send an open-circuit control signal to the power supply control circuit 230 after the power supply 220 is powered-on.

The power supply 220 is configured to convert a voltage (usually an alternating current (AC) voltage of 220 v) provided by the power supply line 300 into a voltage (e.g., a direct current (DC) voltage of 3.3 v) required by the outdoor-unit main control circuit 210, the outdoor-unit communication circuit 240, and other modules of the outdoor unit 200. In this way, the power supply 220 may supply power to the outdoor-unit main control circuit 210, the outdoor-unit communication circuit 240 and other modules after receiving the power supplied by the power supply line 300.

It will be noted that, the embodiments of the present disclosure do not limit the number or type of the power supply 220 of the outdoor unit 200. The power supply 220 may be a power supply with a function of frequency conversion, voltage transformation or AC/DC conversion. For example, the power supply 220 includes a DC current source or an AC current source. There may be one or more power supplies 220. In a case where there is one power supply 220, the power supply 220 may provide corresponding DC voltages or AC voltages for different circuit devices in the outdoor unit 200 at a same time period or at different time periods. In a case where there is a plurality of power supplies 220, each power supply 220 may provide a corresponding DC voltage or AC voltage for a different circuit device in the outdoor unit 200.

The power supply control circuit 230 is disposed in a loop of the power supply line 300 for supplying power to the power supply 220, and is configured to control whether the power supply line 300 supplies power to the power supply 220 by controlling on/off (i.e., on or off) of the loop, so as to control whether the power supply 220 supplies power to other modules of the outdoor unit 200.

The outdoor-unit communication circuit 240 is connected to the indoor-unit communication circuit through the signal line SI, so as to communicate with the indoor-unit communication circuit, and in turn the communication between the indoor unit 100 and the outdoor unit 200 is achieved. As a result, a command received by the indoor unit 100 may be sent to the outdoor unit 200, or an operation state of the outdoor unit 200 may be sent to the indoor unit 100.

It will be noted that, the power supply control circuit 230 may be a part of the outdoor-unit main control circuit 210, or may be independent of the outdoor-unit main control circuit 210. The outdoor-unit communication circuit 240 may be a part of the outdoor-unit main control circuit 210, or may be independent of the outdoor-unit main control circuit 210. The following contents are described only by taking an example in which the power supply control circuit 230 and the outdoor-unit communication circuit 240 are both independent of the outdoor-unit main control circuit 210.

Figure 3:
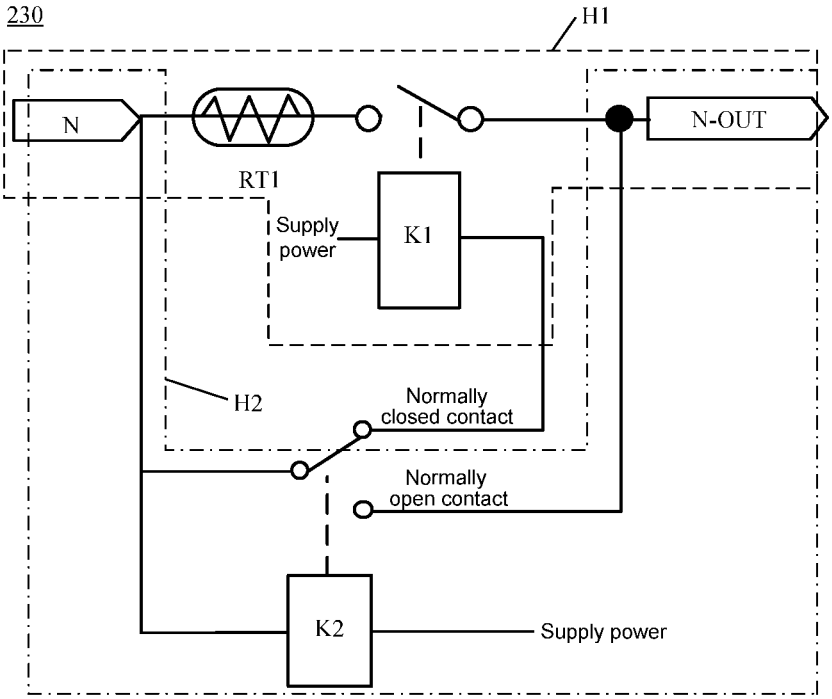
FIG. 3 is a diagram showing a structure of a power supply control circuit in accordance with some embodiments.

It can be seen from the above that, the power supply control circuit 230 is disposed in the loop of the power supply line 300 for supplying power to the power supply 220, and that controlling whether the power supply line 300 supplies power to the power supply 220 is achieved by controlling the state of on or off of the loop. For example, the power supply control circuit 230 is configured to turn on the loop of the power supply line 300 for supplying power to the power supply 220 in response to a power supply control signal (e.g., a predetermined level signal) sent by the indoor unit 100 through the signal line SI, so that the power supply line 300 supplies power to the power supply 220, and in turn the power supply 220 supplies power to each module of the outdoor unit 200. The loop of the power supply line 300 for supplying power to the power supply 220, which is turned on by the power supply control circuit 230 under the control of the power supply control signal, is referred to as a first loop H1 (as shown in FIG. 3).

The predetermined level signal is, for example, a high level lasting for a predetermined time period. The power supply control signal is sent by the indoor unit 100. For example, the power supply control signal may be sent by the indoor-unit communication circuit 130 (shown in FIG. 6), or may be sent by other modules of the indoor unit and transmitted to the signal line SI through the indoor-unit communication circuit 130, which is not limited in the embodiments of the present disclosure. Turning on of the first loop H1 may be maintained by the power supply control signal. For example, the first loop H1 is maintained to be turned on when there is the predetermined level signal, and the first loop H1 is turned off after the predetermined level signal disappears.

Since the signal line SI is a line for the communication between the indoor unit 100 and the outdoor unit 200, and if the power supply control signal (the predetermined level signal, e.g. a high level signal) is always maintained in the signal line SI to maintain a turn-on state of the first loop H1, other communications between the outdoor unit and the indoor unit will be affected. Therefore, after the first loop H1 is turned on to enable the power supply 220 to be powered-on, the power supply control circuit 230 further needs to turn on a second loop H2 (as shown in FIG. 3) of the power supply line 300 for supplying power to the power supply 220 to replace the first loop H1. Therefore, the power supply control circuit 230 is further configured to turn on the second loop H2 in response to the open-circuit control signal sent by the outdoor-unit main control circuit 210, so that the power is supplied to the power supply 220 through the second loop H2 after the power supply control signal disappears, that is, after the first loop H1 is turned off. The loop of the power supply line 300 for supplying power to the power supply 220, which is turned on by the power supply control circuit 230 under the control of the open-circuit control signal, is referred to as the second loop H2.

It will be noted that, the open-circuit control signal may be sent by the outdoor-unit main control circuit 210, or may be sent by other modules, which is not limited in the embodiments of the present disclosure.

In order to enable the outdoor unit 200 and the indoor unit 100 to communicate normally, the power supply control circuit 230 is further configured to turn off a receiving loop of the power supply control signal from the indoor-unit communication circuit 130 to the power supply control circuit 230 in response to the open-circuit control signal sent by the outdoor-unit main control circuit 210, so that a communication signal sent by the indoor-unit communication circuit 130 through the signal line SI flows to the outdoor-unit communication circuit 240, and does not flow to the power supply control circuit 230; as a result, a purpose of a normal communication between the outdoor unit 200 and the indoor unit 100 is achieved. The power supply control circuit 230 is further configured to turn on the receiving loop of the power supply control signal from the indoor-unit communication circuit 130 to the power supply control circuit 230 in response to a disappearance of the open-circuit control signal, thereby preparing for turning on the first loop H1 again.

In order to achieve functions of the power supply control circuit 230, in some embodiments of the present disclosure, as shown in FIG. 3, a circuit structure of the power supply control circuit 230 is provided. The power supply control circuit 230 includes a switch-type relay K1 and a normally closed changeover-type relay K2. The switch-type relay K1 is configured to be turned on in response to the power supply control signal sent by the indoor unit 100 through the signal line SI, so that the first loop H1 of the power supply line 300 for supplying power to the power supply 220 is turned on; that is, the first loop H1 between the neutral wire N and a neutral wire terminal N-OUT (the neutral wire terminal which is also indicated by N1 in FIG. 1 is indicated by N-OUT in FIG. 3) of the outdoor unit 200 is turned on. The normally closed changeover-type relay K2 is configured to switch a movable contact from being connected to a normally closed contact to being connected to a normally open contact in response to the open-circuit control signal sent by the outdoor-unit main control circuit 210, thereby turning off a loop of the signal line 300 for supplying power to the switch-type relay K1 to turn off the first loop H1 of the signal line 300 for supplying power to the power supply 220, and turning on the second loop H2 of the power supply line 300 for supplying power to the power supply 220, i.e., turning on the second loop between the neutral wire N and the neutral wire terminal N-OUT of the outdoor unit 200. Operation states of the switch-type relay K1 and the normally closed changeover-type relay K2 may both be changed by supplying power to them or not.

There are various manners of supplying power to the switch-type relay K1, and different manners of supplying power correspond to different structures of the power supply control circuit 230. Two different structures of the power supply control circuit 230 will be illustrated below, and the manner of supplying power to the switch-type relay K1 will be explained.

Figure 4:
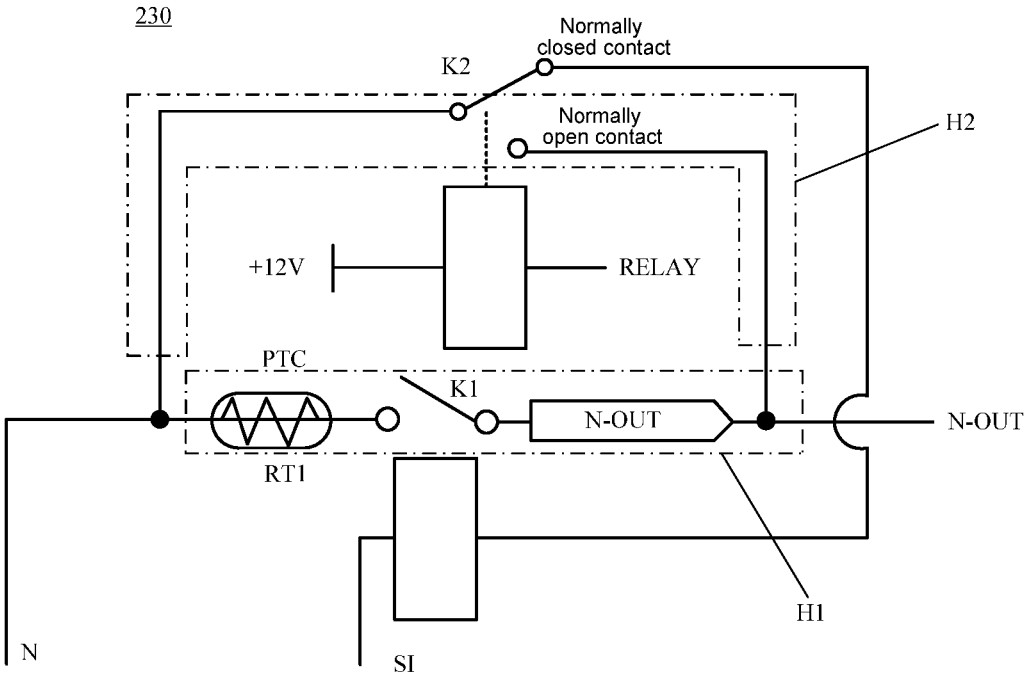
FIG. 4 is a diagram showing another structure of a power supply control circuit in accordance with some embodiments.

In some embodiments, the switch-type relay K1 may be powered by the signal line SI, so that a loop for supplying power the switch-type relay K1 is turned on through the signal line SI. The switch-type relay K1 is configured to be turned on in response to the power supply control signal sent by the indoor unit 100 through the signal line SI, so that the first loop H1 of the power supply line 300 for supplying power to the power supply 220 is turned on. For example, the power supply control circuit 230 adopts the circuit structure shown in FIG. 4 to implement the manner. As shown in FIG. 4, one end of the normally open contact of the switch-type relay K1 is connected to the neutral wire N of the power supply line 300 through a positive temperature coefficient (PTC) resistor RT1, and the other end thereof is connected to the neutral wire terminal N-OUT of the outdoor unit 200. One end of a coil of the switch-type relay K1 is connected to the signal line SI, and the other end thereof is connected to the normally closed contact of the normally closed changeover-type relay K2. The movable contact of the normally closed changeover-type relay K2 is connected to the neutral wire N, and the normally open contact thereof is connected to the neutral wire terminal N-OUT of the outdoor unit 200. The power supply of a coil of the normally closed changeover-type relay K2 is controlled by the outdoor-unit main control circuit 210. The indoor unit 100 sends the power supply control signal to the coil of the switch-type relay K1 through the signal line SI, so that the normally open contact of the switch-type relay K1 is turned on, and the movable contact of the normally closed changeover-type relay K2 is connected to the normally closed contact thereof. As a result, the first loop H1 between the neutral wire N of the power supply line 300 and the neutral wire terminal N-OUT of the outdoor unit 200 is turned on.

Figure 5:
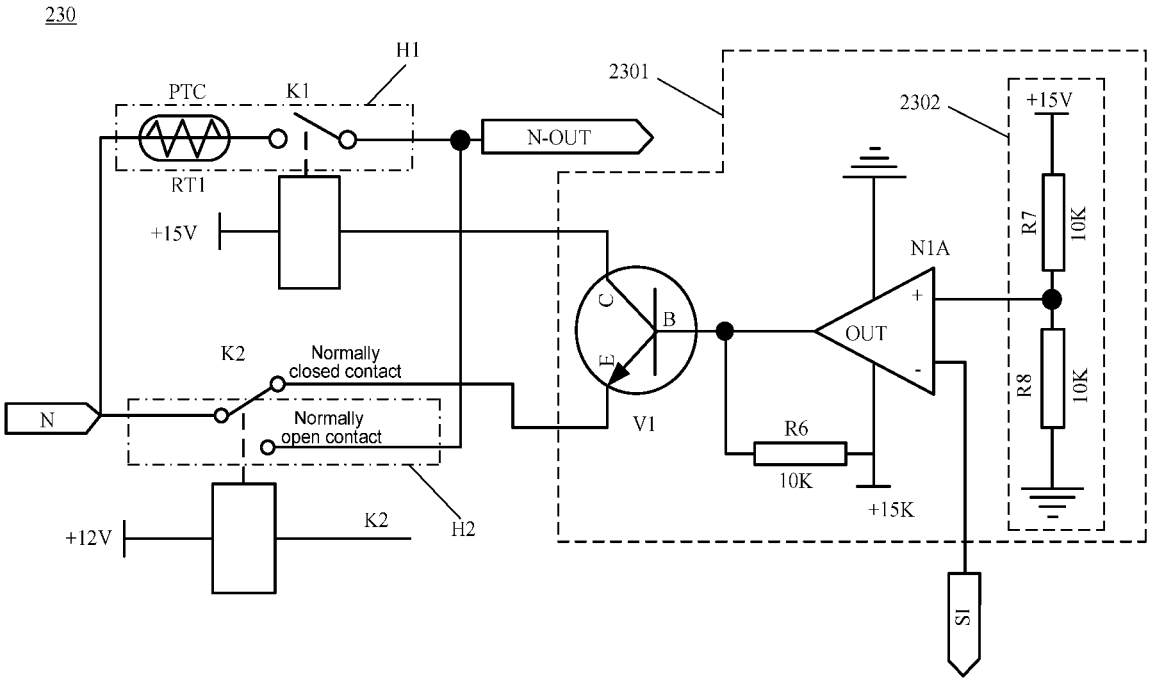
FIG. 5 is a diagram showing another structure of a power supply control circuit in accordance with some embodiments.

In some embodiments, as shown in FIG. 5, the power supply control circuit 230 further includes a level signal supply circuit 2301. The level signal supply circuit 2301 is configured to supply an operation level signal (e.g., a high level signal) to the switch-type relay K1 in response to the power supply control signal sent by the indoor unit 100 through the signal line SI, so that the loop for supplying power the switch-type relay K1 is turned on. The switch-type relay K1 is configured to be turned on in response to the operation level signal sent by the level signal supply circuit 2301, so as to turn on the first loop H1 of the power supply line 300 for supplying power to the power supply 220.

For example, the power supply control circuit 230 may adopt the circuit structure shown in FIG. 5 to implement the manner. The level signal supply circuit 2301 includes a comparator circuit N1A, a triode circuit V1, and a voltage divider circuit 2302. As shown in FIG. 5, the comparator circuit N1A includes a positive input terminal (+), a negative input terminal (−), and an output terminal (OUT). The transistor circuit V1 includes a base electrode (B), a collector electrode (C), and an emitter electrode (E). The positive input terminal (+) of the comparator circuit N1A is configured to receive a preset voltage supplied by the voltage divider circuit 2302, the negative input terminal (−) thereof is used to receive the power supply control signal sent by the indoor unit 100 through the signal line SI, and the output terminal (OUT) is connected to the base electrode (B) of the triode circuit V1. The comparator circuit N1A is configured to output a high level at the output terminal (OUT) after receiving the power supply control signal sent by the indoor unit 100 through the signal line SI at the negative input terminal (−). The collector electrode (C) of the triode circuit V1 is connected to the coil of the switch-type relay K1, and the emitter electrode (E) thereof is connected to the normally closed contact of the normally closed changeover-type relay K2. The triode circuit V1 is configured to turn on the collector electrode (C) and the emitter electrode (E) after receiving the high level at the base electrode (B) thereof output by the output terminal (OUT) of the comparator circuit N1A, thereby turning on the loop for supplying power to the switch-type relay K1. As shown in FIG. 5, one end of the normally open contact of the switch-type relay K1 is connected to the neutral wire N of the power supply line 300 through a PTC resistor RT1, and the other end thereof is connected to the neutral wire terminal N-OUT of the outdoor unit 200. One end of the coil of the switch-type relay K1 is connected to a reference voltage, and the other end thereof is connected to the collector electrode (C) of the triode circuit V1. The movable contact of the normally closed changeover-type relay K2 is connected to the neutral wire N, the normally open contact thereof is connected to the neutral wire terminal N-OUT of the outdoor unit 200, and the power supply of the coil of the normally closed changeover-type relay K2 is controlled by the outdoor-unit main control circuit 210.

The negative input terminal (−) of the comparator circuit N1A outputs a high level at the output terminal (OUT) after receiving the power supply control signal sent by the indoor unit 100 through the signal line SI, and outputs the high level to the base electrode (B) of the triode circuit V1. The triode circuit V1 is of NPN-type, and the base electrode (B) thereof receives the high level, so that the collector electrode (C) and the emitter electrode (E) are turned on, and in turn the loop for supplying power the switch-type relay K1 is turned on. In this case, the switch-type relay K1 is turned on, the movable contact of the normally closed changeover-type relay K2 and the normally closed contact thereof are turned on, and the first loop H1 between the neutral wire N of the power supply line 300 and the neutral wire terminal N-OUT of the outdoor unit 200 is turned on.

Alternatively, in some embodiments, the negative input terminal (−) of the comparator circuit N1A outputs a low level at the output terminal (OUT) after receiving the power supply control signal sent by the indoor unit 100 through the signal line SI, and outputs the low level to the base electrode (B) of the triode circuit V1. The triode circuit V1 is of PNP-type, and the base electrode (B) thereof receives the low level, so that the collector electrode (C) and the emitter electrode (E) are turned on, and in turn the loop for supplying power the switch-type relay K1 is turned on.

It will be noted that, the above are merely two exemplary descriptions of structures of the power supply control circuit 230 and the manner of supplying power to the switch-type relay K1 under the corresponding structure, and the embodiments of the present disclosure do not limited thereto.

The technical solution for implementing power supply through the power supply control circuit 230 will be further described below with reference to FIGS. 6 to 7. For example, a circuit structure of the indoor unit 100 may be as shown in FIG. 6, and a circuit structure of the outdoor unit 200 may be as shown in FIG. 7.

Figure 6:
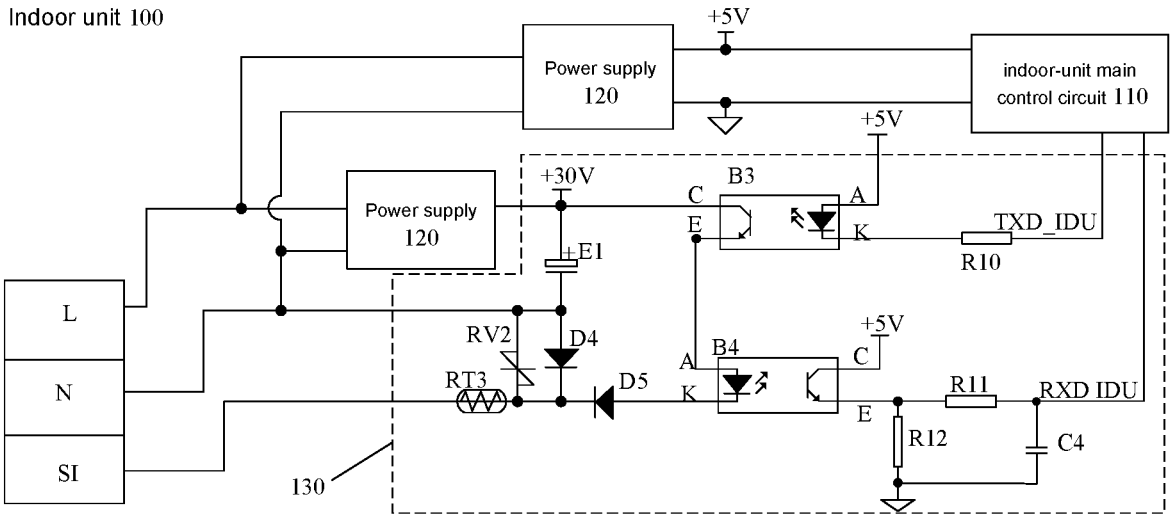
FIG. 6 is a diagram showing a structure of an indoor unit in accordance with some embodiments.

As shown in FIG. 6, the indoor unit 100 includes an indoor-unit main control circuit 110 (also referred to as an indoor-unit main control board), a power supply 120 and an indoor-unit communication circuit 130. The indoor-unit communication circuit 130 includes an optocoupler B3 and an optocoupler B4. The optocoupler B3 is a communication sending terminal (TXD_IDU) of the indoor unit 100, and the optocoupler B4 is the communication receiving terminal (RXD_IDU) of the indoor unit 100. The optocoupler B3 and the optocoupler B4 play a role of isolating signals. The indoor-unit communication circuit 130 further includes a diode D4, a diode D5, a PTC resistor RT3, a varistor RV2, a resistor R10, a resistor R11, a resistor R12, and a capacitor C4. The diode D4 is a reverse freewheeling diode, and plays a role of reverse voltage-withstanding protection. The diode D5 is a forward diode, and plays roles of preventing current from flowing reversely and reverse voltage-withstanding protection. The PTC resistor RT3 plays roles of current limiting and short-circuit overcurrent protection. The varistor RV2 plays a role of surge voltage absorption. The resistor R10 and the resistor R12 play a role of current limiting. The resistor R11 and the capacitor C4 form a RC filter circuit.

Since operation voltages of different circuit devices of the indoor unit 100 may be different, a plurality of different power supplies 120 may be disposed in the indoor unit 100 to supply power to different circuit devices. For example, it is shown in FIG. 6 that a power supply 120 supplying a 5 V voltage required for operation of the indoor-unit main control circuit 110 is separated from a power supply 120 supplying a 30 V voltage required for operation of the indoor-unit communication circuit 130. That is, the 5 V voltage and the 30 V voltage required for operation of the circuit devices may be supplied by different power supplies 120. A specific implementation of supplying power by the power supply 120 will not be described in detail herein, and explanation of the power supply 120 of the indoor unit 100 is similar to explanation of the power supply 220 of the outdoor unit 200.

Figure 7:
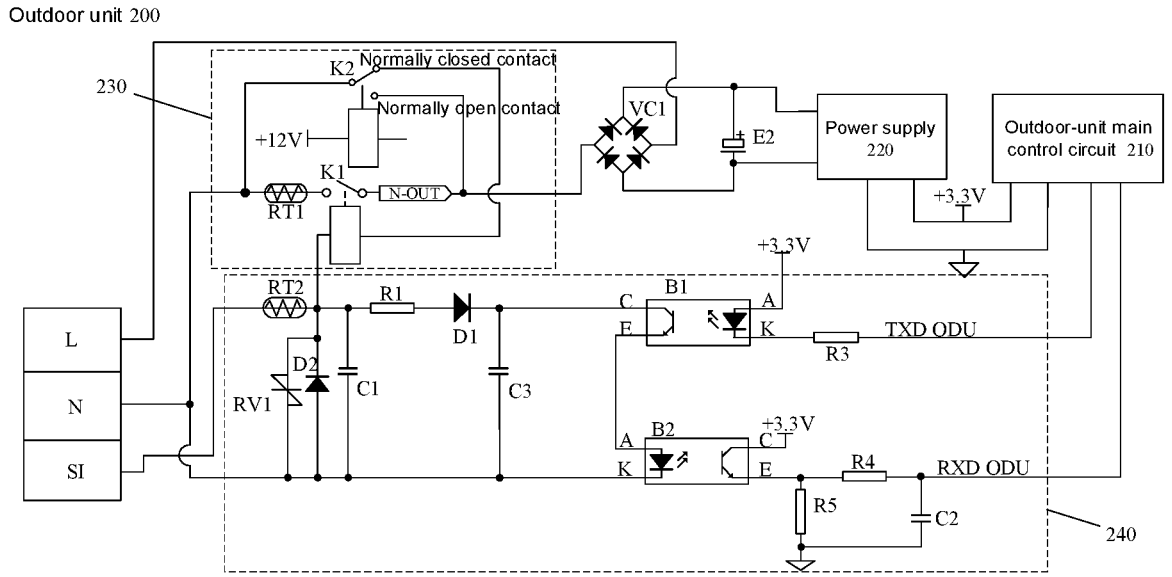
FIG. 7 is a diagram showing a structure of an outdoor unit in accordance with some embodiments.

As shown in FIG. 7, the outdoor-unit communication circuit 240 includes a PTC resistor RT2, a varistor RV1, a diode D1, a diode D2, a resistor R1, a resistor R3, a resistor R4, a resistor R5, a capacitor C1, a capacitor C2, a capacitor C3, and an optocoupler B1 (also referred to as a first optocoupler) and an optical coupler B2 (also referred to as a second optocoupler). The outdoor unit 200 further includes a rectifier bridge VC1 and an electrolytic capacitor E2 at a rear-stage. The PTC resistor RT2 plays roles of current limiting and short-circuit overcurrent protection. The varistor RV1 plays a role of surge voltage absorption. The diode D1 is a forward diode, and plays roles of preventing current from flowing reversely and reverse voltage-withstanding protection. The diode D2 is a reverse freewheeling diode, and plays a role of reverse voltage-withstanding protection. The resistor R1, the resistor R3, and the resistor R5 are current-limiting resistors. The capacitor C1 and the capacitor C3 play a role of filtering. The Optocoupler B1 is a communication sending terminal (TXD_IDU) of the outdoor unit, the optocoupler B2 is a communication receiving terminal (RXD_IDU) of the outdoor unit, and the optocoupler B1 and the optocoupler B2 play a role of isolating signals. The resistor R4 and the capacitor C2 form a RC filter circuit.

Similar to the indoor unit 100, since operation voltages of different circuit devices of the outdoor unit 200 may be different, for example, a 3.3 V voltage and a 12 V voltage shown in FIG. 7 are supplied by different power supplies 220. A specific implementation of supplying power by the power supply 220 will not be described in detail herein.

It will be noted that, in FIGS. 6 and 7, a diode includes an anode A and a cathode K. A triode includes a base electrode B, a collector electrode C, and an emitter electrode E.

When the air conditioner 10 is in a standby state, the optocoupler B3 of the indoor unit 100 shown in FIG. 6 stops sending signals, the outdoor-unit main control circuit 210 shown in FIG. 7 is not energized, and the switch-type relay K1 in the power supply control circuit 230 is turned off, the movable contact of the normally closed changeover-type relay K2 and the normally closed contact thereof are turned on. In this case, the first loop H1 and the second loop H2 between the neutral wire N (also referred to as an N wire) and the neutral wire terminal N-OUT of the outdoor unit 200 are both turned off, i.e., the power supply line 300 cannot supply power to the power supply 220, and in turn the power supply 220 cannot supply power to the outdoor-unit main control circuit 210. As a result, the outdoor unit 200 does not generate standby power consumption, so that the power consumption of the air conditioner 100 in the standby state may be greatly reduced.

When the air conditioner 10 needs to be turned on for operation, the indoor-unit main control circuit 110 controls the collector electrode C and the emitter electrode E (hereinafter referred to as CE) of the optocoupler B3 to be turned on through an microcontroller unit (MCU). After the CE of the optocoupler B3 is turned on, a voltage (e.g., 30 V) with the N wire as a reference ground is output to the outdoor unit 200 sequentially through the optocoupler B3, the optocoupler B4, the diode D5, the PTC resistor RT3, and the signal line SI. Then, the voltage of the signal line SI passes through the PTC resistor RT2 of the outdoor unit 200 and reach the coil of the switch-type relay K1, and returns to the N wire through the normally closed contact of the normally closed changeover-type relay K2, thereby forming a closed current loop. In this case, the switch-type relay K1 is turned on (i.e., the first loop H1 is turned on), and the power supply line 300 supplies power to the rectifier bridge VC1 and the electrolytic capacitor E2 at a rear-stage through the PTC resistor RT1 and the normally open contact of the switch-type relay K1, so that the power supply 220 of the outdoor unit 200 is energized to operate.

It will be noted that, the MCU may be the indoor-unit main control circuit 110 itself or a part of the indoor-unit main control circuit 110.

After the power supply 220 of the outdoor unit 200 is energized to operate, it supplies power to the outdoor-unit main control circuit 210. After the outdoor-unit main control circuit 210 is energized, it provides an open-circuit control signal to the power supply control circuit 230. That is, the outdoor-unit main control circuit 210 energizes the coil of the normally closed changeover-type relay K2, so that the coil of the normally closed changeover-type relay K2 switches the movable contact from being connected to the normally closed contact to being connected to a normally open contact, and enables the N wire is connected to the neutral wire terminal N-OUT of the outdoor unit 200 through the second loop. Power is supplied to the rectifier bridge VC1 and the electrolytic capacitor E2 at a rear-stage continuously to maintain the power supply 220 to operate, thereby ensuring a reliable power supply in the outdoor unit 200. Since the normally closed contact of the normally closed changeover-type relay K2 is turned off, the loop for supplying power to the coil of the switch-type relay K1 is turned off, so that the switch-type relay K1 stops operating (i.e., the first loop is turned off). After the normally closed changeover-type relay K2 is energized, a current signal of the signal line SI flows to the outdoor-unit communication circuit 240. That is, the current signal flows to the optocoupler B1 and the optocoupler B2 through the current-limiting resistor R1 and the forward diode D1 of the outdoor-unit communication circuit 240, so that a communication loop between the indoor-unit communication circuit 130 and the outdoor-unit communication circuit 240 is turned on, and a voltage of the signal line SI is switched between high and low levels with a communication square wave signal. As a result, the indoor-unit main control circuit 110 and the outdoor-unit main control circuit 210 of the air conditioner 10 enter a normal operation state, so that other communication data may be transmitted between the indoor-unit communication circuit 130 and the outdoor-unit communication circuit 240.

Figure 8:
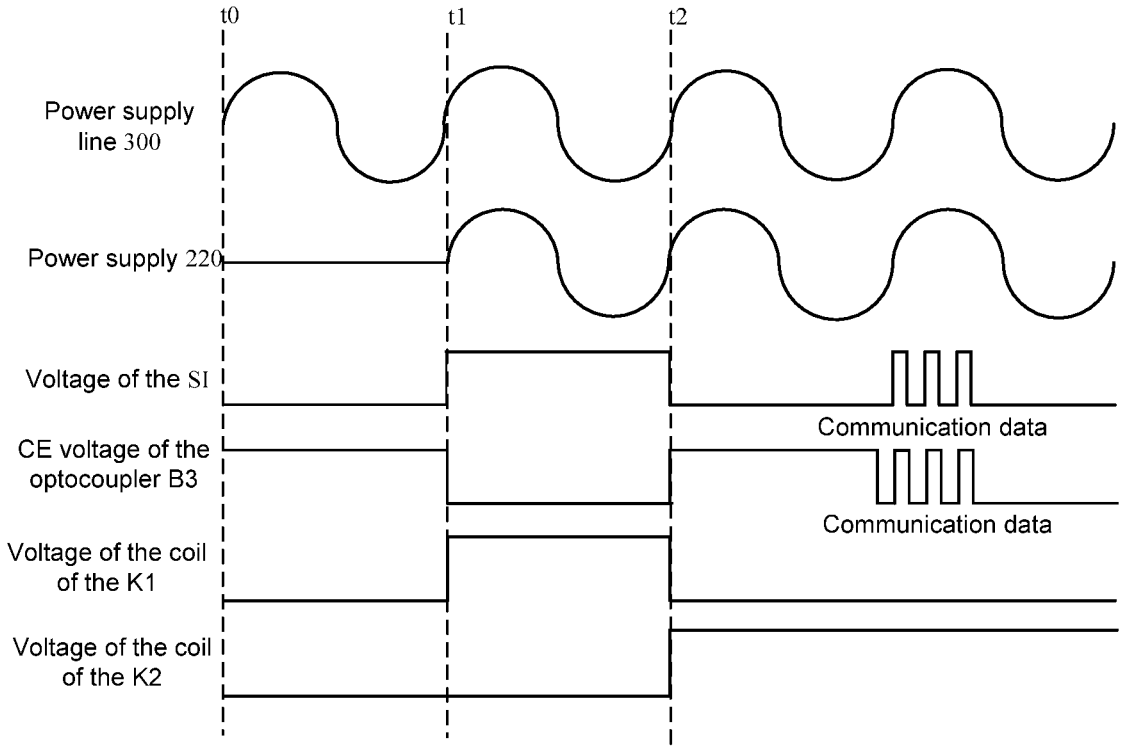
FIG. 8 is a schematic diagram showing an operation timing logic in a startup process of an air conditioner in accordance with some embodiments.

As for an operation timing logic of the circuit during the operation of the air conditioner 10, reference may be made to FIG. 8.

As shown in FIG. 8, the power supply line 300 always has a commercial power with an alternating current. A period t0-t1 is a period during which the optocoupler B3 is turned off, and a CE voltage of the optocoupler B3 is at a high level during this period. During the period t0-t1, the indoor-unit communication circuit 130 does not transmit the power supply control signal to the power supply control circuit 230 of the outdoor unit 200 through the signal line SI, thus the voltage of the signal line SI is at a low level during this period. The switch-type relay K1 and the normally closed changeover-type relay K2 are not energized during the period t0-t1, so that the voltage of the coils of both are at a low level. In addition, the first loop H1 and the second loop H2 of the power supply line 300 for supplying power to the power supply 220 are turned off, and the power supply 220 is not powered-on, so that the voltage of the power supply 220 is 0.

During the period t1-t2, the optocoupler B3 is turned on, and the CE voltage of the optocoupler B3 is at a low level during this period, so that the indoor-unit communication circuit 130 transmits the power supply control signal to the power supply control circuit 230 of the outdoor unit 200 through the signal line SI; the voltage of the signal line SI is at a high level, so that the switch-type relay K1 is energized, the first loop H1 of the power supply line 300 for supplying power to the power supply 220 is turned on, and the power supply 220 starts to be powered on and then supplies power to the outdoor-unit main control circuit 210. At a time t2, the outdoor-unit main control circuit 210 sends an open-circuit control signal to the power supply control circuit 230, the normally closed changeover-type relay K2 is energized, and the voltage of the coil of the normally closed changeover-type relay K2 changes from at a low level to at a high level, so that the second loop H2 of the power supply line 300 for supplying powered to the power supply 220 is turned on; moreover, the switch-type relay K1 is powered-off, and the voltage of the coil of the switch-type relay K1 changes from at a high level to at a low level. After the switch-type relay K1 is powered-off, the voltage of the signal line SI also changes from at a high level to at a low level; thereafter, the signal line SI may transmit other communication data.

Figure 9:
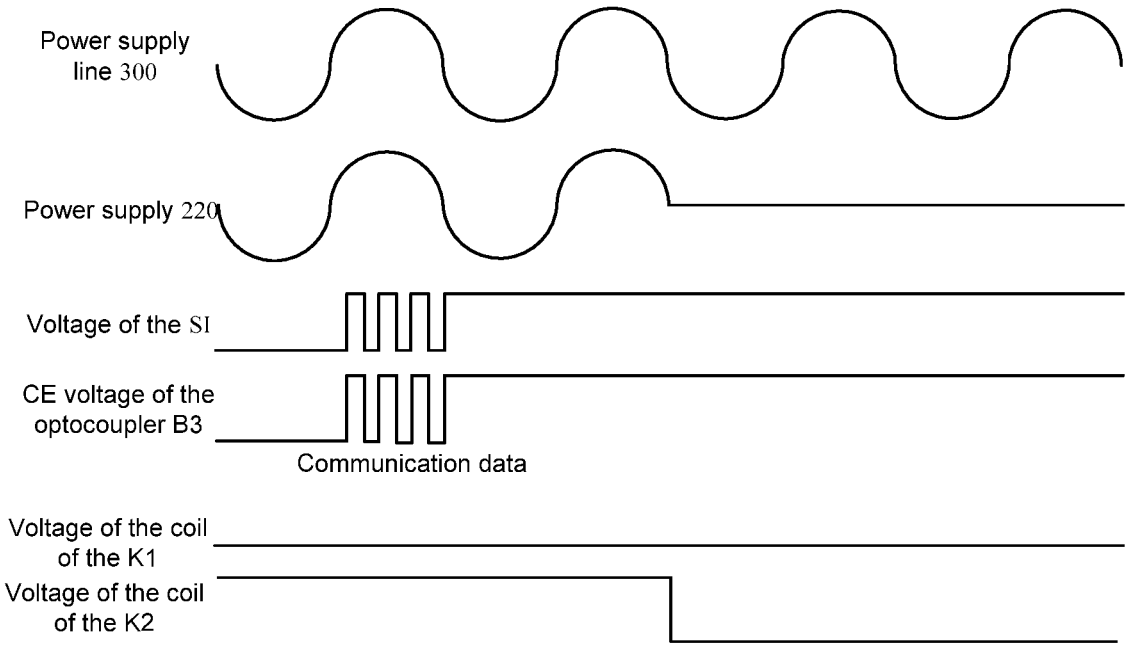
FIG. 9 is a schematic diagram showing an operation timing logic in a shutdown process of an air conditioner in accordance with some embodiments.

When the air conditioner receives a shutdown command, the optocoupler B3 of the indoor unit 100 stops sending signals, the outdoor-unit main control circuit 210 stops supplying power to the normally closed changeover-type relay K2, and the normally closed changeover-type relay K2 switches the movable contact from being connected to the normally open contact to being connected to the normally closed contact, so as to disconnect the N wire and the neutral wire terminal N-OUT of the outdoor unit 200 (i.e., the second loop H2 is turned off). Since the optocoupler B3 is turned off at this time and no current flows through the switch-type relay K1, the switch-type relay K1 maintains a powered-off state. The outdoor-unit main control circuit 210 is deenergized and stops operating, and waits for a next startup command. As for an operation timing logic of the circuit in this process, reference may be made to FIG. 9.

Figure 10:
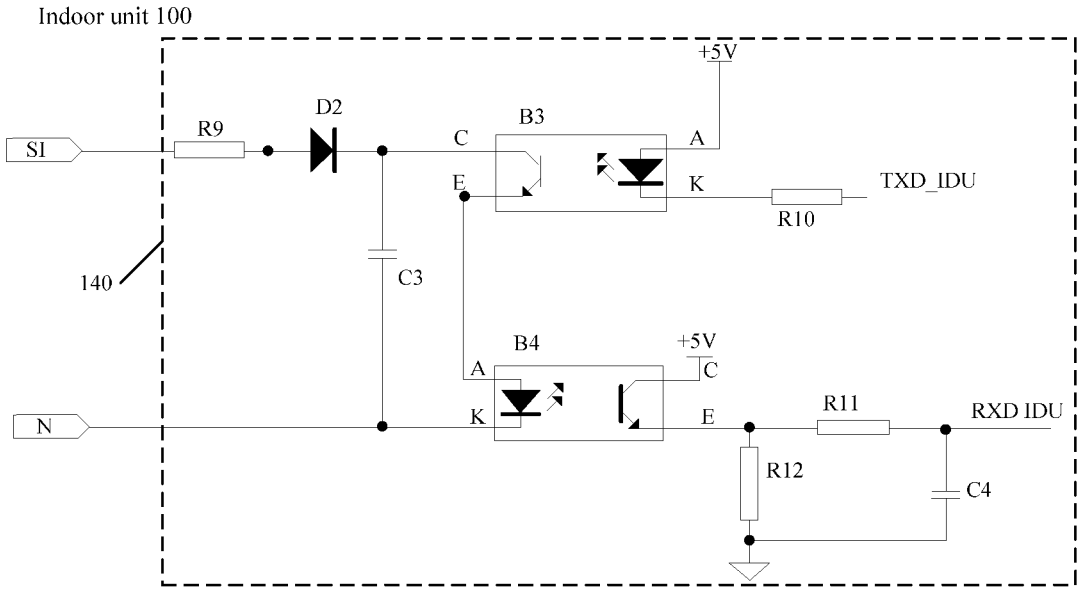
FIG. 10 is a diagram showing another structure of an indoor unit in accordance with some embodiments.
Figure 11:
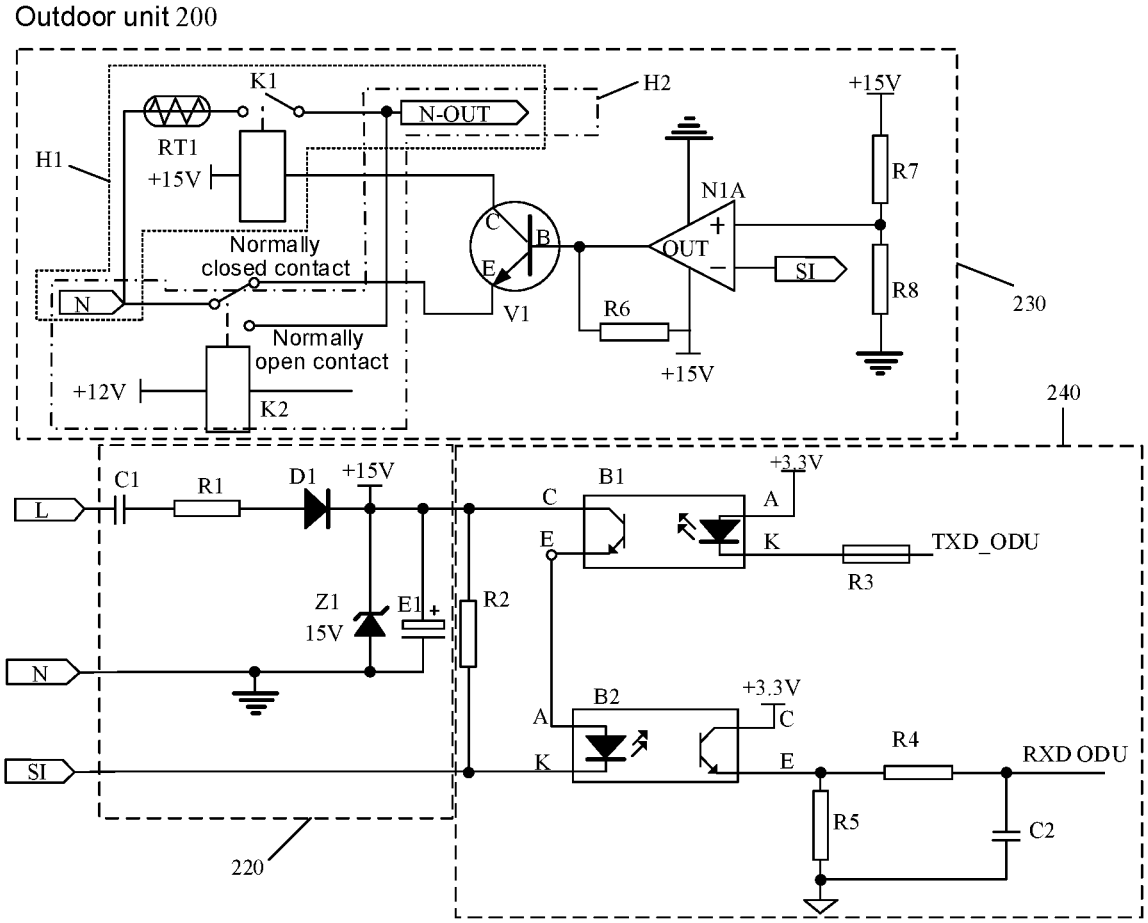
FIG. 11 is a diagram showing another structure of an outdoor unit in accordance with some embodiments.

In some other embodiments of the present disclosure, a circuit structure of the indoor unit 100 may be as shown in FIG. 10, and a circuit structure of the outdoor unit 200 may be as shown in FIG. 11.

As shown in FIG. 10, the indoor-unit communication circuit 130 includes a resistor R9, a resistor R10, a resistor R11, a resistor R12, a diode D2, a capacitor C3, a capacitor C4, an optocoupler B3, and an optocoupler B4. The resistor R9, the resistor R10, and the resistor R12 are current-limiting resistors. The diode D2 plays a role of reverse voltage-withstanding protection. The capacitor C3 plays a role of filtering. The Optocoupler B3 is a communication sending terminal (TXD_IDU) of the indoor unit 100, the optocoupler B4 is a communication receiving terminal (RX-D_IDU) of the indoor unit 100, and the optocoupler B3 and the optocoupler B4 play a role of isolating signals. The resistor R11 and the capacitor C4 form a RC filter circuit.

As shown in FIG. 11, the power supply control circuit 230 includes a switch-type relay K1, a normally closed changeover-type relay K2, a comparator circuit N1A, a triode circuit V1, a resistor R6, a resistor R7, a resistor R8, and a PTC resistor RT1 and other components. The power supply 220 includes a capacitor C1, a resistor R1, a diode D1, a voltage stabilizing diode Z1, and a voltage stabilizing capacitor E1. The outdoor-unit communication circuit 240 includes components such as an optocoupler B1 (also referred to as a first optocoupler), an optocoupler B2 (also referred to as a second optocoupler), a resistor R3, a resistor R4, a resistor R5 and a capacitor C2.

The capacitor C1, the resistor R1 and the diode D1 form a resistance-capacitance step-down half-wave rectifier circuit; the voltage stabilizing diode Z1 and the voltage stabilizing capacitor E1 form a voltage stabilizing circuit; and a power of a stabilizing voltage at, for example, 15 V, is generated with the N wire as the reference ground by the power supply 220. The Optocoupler B1 is a communication sending terminal (TXD_IDU) of the outdoor unit, the optocoupler B2 is a communication receiving terminal (RX-D_IDU) of the outdoor unit, and the optocoupler B1 and the optocoupler B2 play a role of isolating signals. The resistor R2 plays a role of voltage division. The resistor R3 and the resistor R5 play a role of current limiting. The resistor R4 and the capacitor C2 form a RC filter circuit.

A positive input terminal (+) of the comparator circuit N1A of the power supply control circuit 230 may be input, for example, a constant level of 7.5 V, which is generated by a voltage divider circuit composed of the resistor R7 and the resistor R8. A negative input terminal (−) of the comparator circuit N1A receives the signal sent by the signal line SI. The resistor R6 is a pull-up resistor of an output terminal (OUT) of the comparator circuit N1A. The output terminal (OUT) of the comparator circuit N1A controls a base electrode (a B electrode) of the NPN-type triode circuit V1. The triode circuit V1 may control the on or off of the switch-type relay K1. The PTC resistor RT1 limits an impact current when the outdoor unit 200 is energized. When the coil of the normally closed changeover-type relay K2 is not energized, the movable contact is connected to the normally closed contact, so that the N wire is connected to an emitter electrode (an E electrode) of the triode circuit V1. The movable contact is connected to the normally open contact when the coil of the normally closed changeover-type type relay K2 operates, so that the N wire is connected to the neutral wire terminal N-OUT of the outdoor unit 200, and power is supplied to the power supply 220.

When the air conditioner 10 is in a standby state, the outdoor-unit main control circuit 210 is not energized, the optocoupler B1 has no power signal, and the CE terminal of the optocoupler B1 is turned off. The optocoupler B3 of the indoor-unit communication circuit 130 does not receive the startup command and is also in a turn-off state. At this time, a voltage of the signal line SI is equal to an output voltage of the voltage stabilizing diode Z1 (e.g., 15 V), and a voltage of the positive input terminal (+) of the comparator circuit N1A is 7.5 V. The negative input terminal (−) of the comparator circuit receives the 15 V voltage of the signal line SI, which is higher than the 7.5 V voltage of the positive input terminal (+), so that the comparator circuit N1A outputs a low level, and the CE terminal of the triode circuit V1 cannot be turned on, and in turn the switch-type relay K1 cannot be energized to operate. As a result, the first loop H1 between the N wire and the neutral wire terminal N-OUT of the outdoor unit 200 is not turned on, the power supply line 300 cannot supply power to the power supply 220, and then the power supply 220 cannot supply power to the outdoor-unit main control circuit 210, thus the outdoor-unit main control circuit 210 does not generate the standby power consumption.

Figure 12:
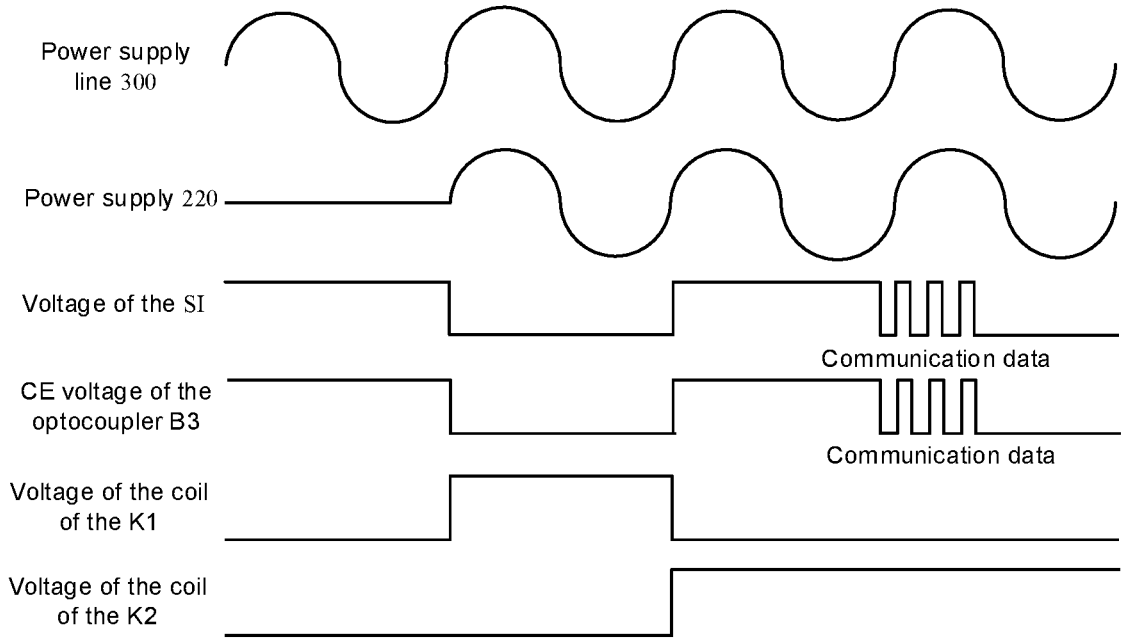
FIG. 12 is a schematic diagram showing another operation timing logic in a startup process of an air conditioner in accordance with some embodiments.

When the air conditioner 10 needs to be turned on for operation, the indoor-unit main control circuit 110 controls the CE terminal of the optocoupler B3 to be turned on through the MCU. Due to voltage division effect of the resistor R2 and the resistor R9, the voltage of the signal line SI is changed to 5 V (15 V×5 K/15 K), that is, the voltage input to the negative input terminal (−) of the comparator circuit N1A is changed to 5 V. At this time, the voltage of the positive input terminal (+) of the comparator circuit N1A is still 7.5 V. Since the 7.5 V voltage of the positive input terminal (+) of the comparator circuit N1A is higher than the 5 V voltage of the negative input terminal (−) thereof, the output terminal (OUT) of the comparator circuit N1A outputs a 15 V high level, and the CE terminal of the triode circuit V1 is turned on. The normally open contact of the switch-type relay K1 is turned on, the first loop H1 between the N wire and the neutral wire terminal N-OUT of the outdoor unit 200 is turned on, so that the N wire supplies power to the power supply 220 through the PTC resistor RT1, and the power supply 220 supplies power to the outdoor-unit main control circuit 210. After the outdoor-unit main control circuit 210 is energized to operate, the coil of the normally closed changeover-type relay K2 is energized (i.e., sending the open-circuit control signal to the power supply control circuit 230), so that the movable contact is switched from being connected to the normally closed contact to being connected to the normally open contact, and the connection between the emitter electrode E of the triode circuit V1 and the N wire is turned off. As a consequence, the switch-type relay K1 stops operating, and the first loop H1 is turned off. At the same time, the second loop H2 between the N wire and the neutral wire terminal N-OUT of the outdoor unit 200 is turned on, which is continue to supply power to the power supply 220, thereby ensuring a reliability of power supply of the outdoor unit. Meanwhile, since the movable contact of the normally closed changeover-type relay K2 is disconnected from the normally closed contact, the loop for supplying power to the coil of the switch-type relay K1 is turned off, the switch-type relay K1 stops operating; and the current signal flows to the outdoor-unit communication circuit 240, so as to turn on the communication loop between the indoor-unit communication circuit 130 and the outdoor-unit communication circuit 240; then the indoor-unit main control circuit 110 and the outdoor-unit main control circuit 210 of the air conditioner 10 enter normal operation states, so that other communication data may be transmitted between the indoor-unit communication circuit 130 and the outdoor-unit communication circuit 240. As for an operation timing logic of the circuit in this process, reference may be made to FIG. 12.

Figure 13:
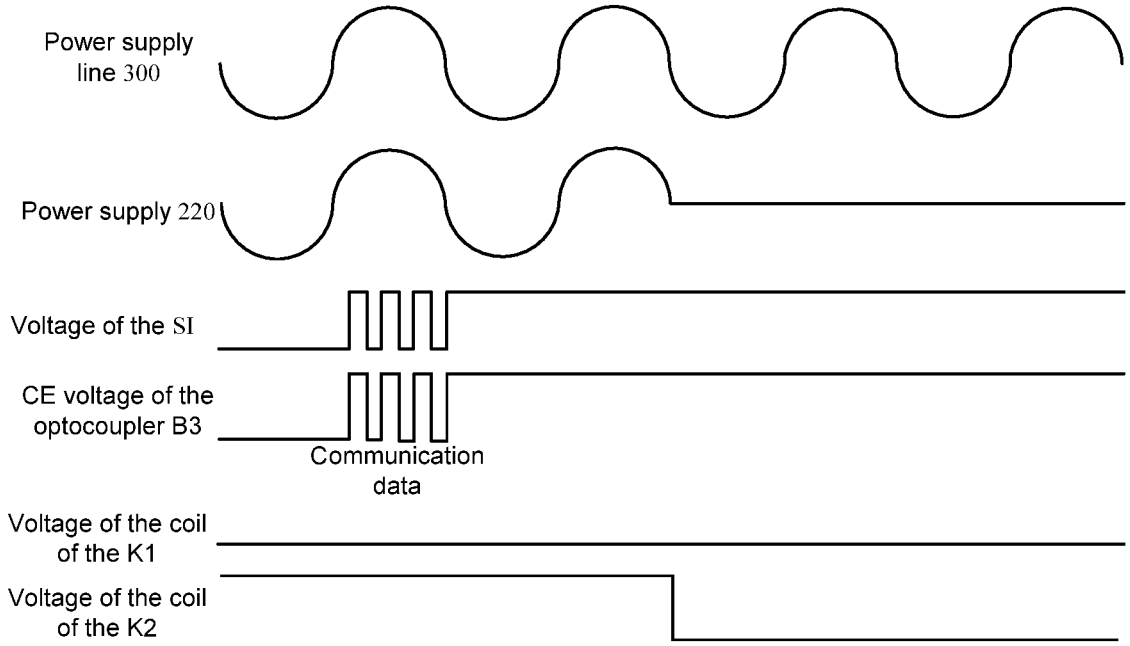
FIG. 13 is a schematic diagram showing another operation timing logic in a shutdown process of an air conditioner in accordance with some embodiments.

When the air conditioner 10 receives a shutdown command, the optocoupler B3 of the indoor unit 100 and the optocoupler B1 of the outdoor unit 200 stop sending signals. The outdoor-unit main control circuit 210 stops supplying power to the normally closed changeover-type relay K2 and the second loop H2 is turned off. Since a voltage from the signal line SI to the negative input terminal (−) of the comparator circuit N1A is 15 V at this time, the switch-type relay K1 is also in an off state. The outdoor-unit main control circuit 210 is deenergized and stops operating, and waits for a next startup command. As for an operation timing logic of the circuit in this process, reference may be made to FIG. 13.

It will be noted that, the above embodiments are all examples of the present disclosure. In actual applications, the power supply control circuit 230 may further include more or fewer circuit devices, which is not limited in the embodiments of the present disclosure.

Other circuits or modules, such as the outdoor-unit main control circuit 210 or the outdoor-unit communication circuit 240, may also include more or fewer circuit devices to implement more or fewer functions. For example, the outdoor-unit main control circuit 210 is further configured to stop sending the open-circuit control signal after the outdoor-unit communication circuit 240 receives the shutdown signal sent by the indoor-unit communication circuit 130. The normally closed changeover-type relay K2 is further configured to switch the movable contact from being connected to the normally open contact to being connected to the normally closed contact after the outdoor-unit main control circuit 210 stops sending the open-circuit control signal, and turn on the loop of the signal line SI for supplying power to the switch-type relay K1.

In the technical solutions provided by some embodiments of the present disclosure, the on or off of the power supply control circuit 230 is able to be controlled through the signal line SI by the indoor unit 100, thereby whether to supply power to the outdoor unit 200 is controlled. Since a voltage (e.g., 30 V) of the signal line SI is low, for example, lower than the voltage provided by the power supply line 300 (usually 220 V), a requirement on diameter of the signal line SI of the air conditioner 10 is low, so that a cost may be reduced, and the reliability of supplying power to the outdoor unit 200 may be ensured.

In the technical solutions provided by some embodiments of the present disclosure, when the air conditioner 10 is in a standby state, the optocoupler B3 of the indoor unit 100 stops sending signals, so as to stop supplying power to the outdoor-unit main control circuit 210, so that the standby power consumption of the air conditioner 10 is reduced. When the air conditioner 10 needs to be turned on for operation, the indoor-unit communication circuit 130 provides a power supply control signal to the power supply control circuit 230 of the outdoor unit 200, so that the first loop H1 of the power supply control circuit 230 is turned on, and the power supply line 300 supplies power to the power supply 220 through the power supply control circuit 230. After the power supply 220 is powered on, it supplies power to the outdoor-unit main control circuit 210. The energized outdoor-unit main control circuit 210 sends an open-circuit control signal to the power supply control circuit 230, so that the first loop H1 is turned off, the second loop H2 is turned on, and the power supply line 300 continues to supply power to the power supply 220. At this time, the current signal output by the signal line SI flows to the outdoor-unit communication circuit 240 instead of the power supply control circuit 230. In this way, while ensuring the reliability of the power supply of the power supply 220, the communication connection between the indoor-unit communication circuit 130 and the outdoor-unit communication circuit 240 is also realized, so that the indoor-unit main control circuit 110 and the outdoor-unit main control circuit of the air conditioner 10 enter normal operation states.

Finally, it will be noted that, the above embodiments are only used to illustrate the technical solutions of the present disclosure, but not to limit the same. Although the present disclosure are described in detail with reference to the foregoing embodiments, those of ordinary skill in the art will understand that the technical solutions described in the foregoing embodiments may still be modified, or some of the technical features may be equivalently replaced, and these modifications or replacements do not deviate essences of corresponding technical solutions from the scope of the technical solutions of the embodiments of the present disclosure.

What is claimed is:

1. An outdoor unit of an air conditioner, comprising: an outdoor-unit main control circuit, a power supply, a power supply control circuit, and an outdoor-unit communication circuit;

the outdoor-unit main control circuit being configured to control operations of the power supply, the power supply control circuit and the outdoor-unit communication circuit, and control a communication between the outdoor unit of the air conditioner and an indoor unit of the air conditioner;

the outdoor-unit communication circuit being configured to communicate with the indoor unit of the air conditioner through a signal line connecting an indoor-unit communication circuit of the indoor unit of the air conditioner and the outdoor-unit communication circuit;

the power supply control circuit being disposed in a loop of a power supply line for supplying power to the power supply, and being configured to control the power supply line to supply power to the power supply by controlling on/off of the loop; and the power supply being configured to supply power to the outdoor-unit main control circuit and the outdoor-unit communication circuit after receiving the power supplied from the power supply line, wherein the power supply control circuit includes a first loop and a second loop; the first loop is a loop turned on under a control of a power supply control signal for supplying power to the power supply by the power supply line; the power supply control signal is a signal sent by the indoor-unit communication circuit to the power supply control circuit through the signal line; the second loop is a loop turned on under a control of an open-circuit control signal for supplying power to the power supply by the power supply line; and the open-circuit control signal is a signal sent by the outdoor-unit main control circuit to the power supply control circuit after the power supply is powered on through the first loop, wherein the first loop includes a switch-type relay, and the second loop includes a normally closed changeover-type relay; the switch-type relay is configured to be turned on in response to the power supply control signal, so as to turn on the first loop; and the normally closed changeover-type relay is configured to switch a movable contact thereof from being connected to a normally closed contact thereof to being connected to a normally open contact thereof in response to the open-circuit control signal, so as to turn on the second loop and turn off the first loop.

2. The outdoor unit of the air conditioner according to claim 1, wherein the power supply control circuit is further configured to turn off a receiving loop of the power supply control signal from the indoor-unit communication circuit to the power supply control circuit in response to the open-circuit control signal.

3. The outdoor unit of the air conditioner according to claim 2, wherein the power supply control circuit is further configured to turn on the receiving loop of the power supply control signal from the indoor-unit communication circuit to the power supply control circuit in response to a disappearance of the open-circuit control signal, so as to turn on the first loop again.

4. The outdoor unit of the air conditioner according to claim 1, wherein the switch-type relay is supplied power by the signal line, and is configured to turn on the first loop in response to the power supply control signal transmitted by the indoor-unit communication circuit through the signal line.

5. The outdoor unit of the air conditioner according to claim 4, wherein one end of a normally open contact of the switch-type relay is connected to a neutral wire of the power supply line, and another end thereof is connected to a neutral wire terminal of the outdoor unit; one end of a coil of the switch-type relay is connected to the signal line, and another end thereof is connected to the normally closed contact of the normally closed changeover-type relay;

the movable contact of the normally closed changeover-type relay is connected to the neutral wire of the power supply line, the normally open contact thereof is connected to the neutral wire terminal of the outdoor unit, and power supply of a coil of the normally closed changeover-type relay is controlled by the outdoor-unit main control circuit.

6. The outdoor unit of the air conditioner according to claim 1, wherein the power supply control circuit further includes a level signal supply circuit, and the switch-type relay is supplied power by the level signal supply circuit;

the level signal supply circuit is configured to provide an operation level signal to the switch-type relay in response to the power supply control signal transmitted by the indoor-unit communication circuit through the signal line;

the switch-type relay is configured to turn on the first loop in response to the operation level signal.

7. The outdoor unit of the air conditioner according to claim 6, wherein the level signal supply circuit includes a comparator circuit, a triode circuit, and a voltage divider circuit;

wherein the comparator circuit includes a positive input terminal, a negative input terminal, and an output terminal; the positive input terminal is connected to the voltage divider circuit, the negative input terminal is connected to the signal line, and the output terminal is connected to the triode circuit; the comparator circuit is configured to output a level signal at the output terminal in response to the power supply control signal transmitted by the indoor-unit communication circuit to the negative input terminal;

the triode circuit includes a base electrode, a collector electrode, and an emitter electrode; the base electrode is connected to the output terminal of the comparator circuit, the collector electrode is connected to a coil of the switch-type relay, and the emitter electrode is connected to the normally closed contact of the normally closed changeover-type relay; the triode circuit is configured to turn on the collector electrode and the emitter electrode in response to the level signal output from the output terminal of the comparator circuit, so as to turn on a loop for supplying power to the switch-type relay.

8. The outdoor unit of the air conditioner according to claim 7, wherein one end of a normally open contact of the switch-type relay is connected to a neutral wire of the power supply line, and another end thereof is connected to a neutral wire terminal of the outdoor unit; one end of a coil of the switch-type relay is connected to a reference voltage, and another end thereof is connected to the collector electrode;

the movable contact of the normally closed changeover-type relay is connected to the neutral wire of the power supply line, the normally open contact thereof is connected to the neutral wire terminal of the outdoor unit, and the power supply of the coil of the normally closed changeover-type relay is controlled by the outdoor-unit main control circuit.

9. The outdoor unit of the air conditioner according to claim 8, wherein the power supply includes a resistance-capacitance step-down half-wave rectifier circuit and a voltage stabilizing circuit; an input terminal of the resistance-capacitance step-down half-wave rectifier circuit is connected to the power supply line, and an output terminal thereof is connected to an input terminal of the voltage stabilizing circuit, and an output terminal of the voltage stabilizing circuit is connected to the outdoor-unit communication circuit.

10. The outdoor unit of the air conditioner according to claim 9, wherein the voltage stabilizing circuit includes a voltage stabilizing diode and a voltage stabilizing capacitor connected in parallel, and the resistance-capacitance step-down half-wave rectifier circuit includes a diode;

a cathode of the voltage stabilizing diode is connected to a positive electrode of the voltage stabilizing capacitor and a cathode of the diode, and an anode of the voltage stabilizing diode is connected to a negative electrode of the voltage stabilizing capacitor and the neutral wire of the power supply line.

11. The outdoor unit of the air conditioner according to claim 8, wherein a communication sending terminal of the outdoor-unit communication circuit is a first optocoupler, and a communication receiving terminal thereof is a second optocoupler; wherein an anode of the first optocoupler is connected to a direct current power source, a cathode thereof is connected to the outdoor-unit main control circuit, a collector electrode of the first optocoupler is connected to an output terminal of the power supply, and an emitter electrode of the first optocoupler is connected to an anode of the second optocoupler;

a cathode of the second optocoupler is connected to the signal line, a collector electrode of the second optocoupler is connected to the direct current power source, and an emitter electrode of the second optocoupler is connected to the outdoor-unit main control circuit.

12. The outdoor unit of the air conditioner according to claim 11, wherein the direct current power source is obtained by converting a voltage provided by the power supply line by the power supply.

13. An air conditioner, comprising: an indoor unit of the air conditioner, an outdoor unit of the air conditioner, and a power supply line for providing the air conditioner with commercial power, wherein the indoor unit of the air conditioner includes an indoor-unit communication circuit and an indoor-unit main control circuit; and the indoor-unit communication circuit is connected to an outdoor-unit communication circuit of the outdoor unit of the air conditioner through a signal line, and is connected to a power supply control circuit of the outdoor unit of the air conditioner through the signal line;

wherein the outdoor unit of the air conditioner includes an outdoor-unit main control circuit, a power supply, the power supply control circuit and the outdoor-unit communication circuit;

the outdoor-unit main control circuit is configured to control operations of the power supply, the power supply control circuit and the outdoor-unit communication circuit, and control a communication between the outdoor unit of the air conditioner and the indoor unit of the air conditioner;

the outdoor-unit communication circuit is configured to communicate with the indoor unit of the air conditioner through the signal line connecting the indoor-unit communication circuit of the indoor unit of the air conditioner and the outdoor-unit communication circuit;

the power supply control circuit is disposed in a loop of the power supply line for supplying power to the power supply, and configured to control the power supply line to supply power to the power supply by controlling on/off of the loop; and the power supply is configured to supply power to the outdoor-unit main control circuit and the outdoor-unit communication circuit after receiving the power supplied from the power supply line, wherein a live wire terminal of the outdoor unit of the air conditioner is connected to a live wire terminal of the indoor unit of the air conditioner, and both of live wire terminals are jointly connected to a live wire of the power supply line;

wherein a neutral wire terminal of the outdoor unit of the air conditioner is connected to a neutral wire terminal of the indoor unit of the air conditioner, and both of neutral wire terminals are jointly connected to a neutral wire of the power supply line.

14. The air conditioner according to claim 13, wherein the indoor unit of the air conditioner is configured to send a power supply control signal to the power supply control circuit through the signal line.

15. The air conditioner according to claim 14, wherein the power supply control circuit turns on a first loop of the power supply line for supplying power to the power supply of the outdoor unit of the air conditioner under a control of the power supply control signal.

16. The air conditioner according to claim 15, wherein after the power supply is powered on, the outdoor-unit main control circuit of the outdoor unit of the air conditioner is further configured to send an open-circuit control signal; the power supply control circuit turns on a second loop of the power supply line for supplying power to the power supply and turn off the first loop under a control of the open-circuit control signal.

17. The air conditioner according to claim 16, wherein the outdoor-unit main control circuit is further configured to stop sending the open-circuit control signal after the outdoor-unit communication circuit receives a shutdown signal sent by the indoor-unit communication circuit.

* * * * *